US007542709B2

(12) United States Patent
Uehara et al.

(10) Patent No.: US 7,542,709 B2
(45) **Date of Patent: *Jun. 2, 2009**

(54) IMAGE-FORMING DEVICE FOR SUPPRESSING RECORDING SHEET FROM FLAPPING WHEN TRANSFERRING TONER IMAGES THEREON

(75) Inventors: Junji Uehara, Inazawa (JP); Hideaki Deguchi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/878,505

(22) Filed: Jul. 25, 2007

(65) Prior Publication Data

US 2007/0269243 A1 Nov. 22, 2007

Related U.S. Application Data

(63) Continuation-in-part of application No. 11/340,539, filed on Jan. 27, 2006.

(30) Foreign Application Priority Data

Jan. 28, 2005 (JP) ..... P2005-021992
Jan. 28, 2005 (JP) ..... P2005-021993
Jul. 25, 2006 (JP) ..... P2006-202202

(51) Int. Cl.
*G03G 15/16* (2006.01)

(52) U.S. Cl. ..... 399/316; 399/317

(58) Field of Classification Search ..... 399/316, 399/317

See application file for complete search history.

(56) References Cited

U.S. PATENT DOCUMENTS 4,882,606 A * 11/1989 Deguchi ..... 399/316
5,144,383 A * 9/1992 Murano et al. ..... 399/316
5,155,539 A * 10/1992 Yamaguchi et al. ..... 399/317
5,220,396 A * 6/1993 Monma et al. ..... 399/121
5,592,278 A * 1/1997 Sato et al. ..... 399/384
2005/0069343 A1 3/2005 Deguchi et al.
2006/0171760 A1 8/2006 Deguchi
2007/0269242 A1* 11/2007 Hattori et al. ..... 399/316
2007/0269244 A1 11/2007 Miwa et al.

FOREIGN PATENT DOCUMENTS

CN 1073534 A 6/1993

(Continued)

OTHER PUBLICATIONS

European Search Report issued in European Patent Application No. EP 06 00 1618 dated May 15, 2006.
Chinese Office Action with English translation issued in Chinese Patent Application No. 2006100071765, dated Jun. 27, 2008.

*Primary Examiner*—David M Gray
*Assistant Examiner*—Ryan D Walsh
(74) *Attorney, Agent, or Firm*—McDermott Will & Emery LLP

(57) ABSTRACT

In an image-forming device including a photosensitive drum, a transfer roller, and a guide plate for guiding a recording sheet toward the photosensitive drum, a sponge is disposed between the guide plate and a transfer position where a developer image on the photosensitive drum is transferred to the recording sheet. The sponge can receive the trailing edge of the paper leaving the guide plate to suppress flapping of the trailing edge.

18 Claims, 5 Drawing Sheets

FOREIGN PATENT DOCUMENTS

| | | | | |
|---|---|---|---|---|
| EP | 0549089 | A1 | | 6/1993 |
| EP | 1 031 891 | A1 | | 8/2000 |
| JP | 59206846 | A | * | 11/1984 |
| JP | 63-43473 | | | 3/1988 |
| JP | 2-136269 | | | 11/1990 |
| JP | 7-160129 | | | 6/1995 |
| JP | 7-181815 | | | 7/1995 |
| JP | 8-36313 | | | 2/1996 |
| JP | 11-338279 | | | 12/1999 |
| JP | 2002072704 | A | * | 3/2002 |
| JP | 2003-5535 | | | 1/2003 |
| JP | 2006-208839 | | | 8/2006 |
| JP | 2006-208840 | | | 8/2006 |

* cited by examiner

IMAGE-FORMING DEVICE FOR SUPPRESSING RECORDING SHEET FROM FLAPPING WHEN TRANSFERRING TONER IMAGES THEREON

CROSS REFERENCE TO RELATED APPLICATIONS

This application is a continuation-in-part application of application Ser. No. 11/340,539 filed Jan. 27, 2006, claiming priorities from Japanese patent application Nos. 2005-21992 and 2005-21993 both filed Jan. 28, 2005. This application further claims priority from Japanese Patent Application No. 2006-202202 filed Jul. 25, 2006. The entire contents of these priority applications are incorporated herein by reference.

BACKGROUND OF THE INVENTION

1. Field of the Invention

The present invention relates to an image-forming device such as a laser printer, and to a process cartridge detachably provided in the image-forming device.

2. Description of the Related Art

Generally, laser printers and other electrophotographic image-forming devices are provided with a photosensitive drum for carrying a developer image, and a transfer roller disposed in contact with the photosensitive drum for attracting the developer image with a transfer bias applied to the transfer roller. When a sheet of paper passes between the photosensitive drum and the transfer roller, the developer image migrates toward the transfer roller and is transferred onto the paper, forming an image thereon. However, when the paper is separated from the photosensitive drum at a position upstream of a transfer position between the photosensitive drum and the transfer roller with respect to the paper-conveying direction, a pre-transfer may occur in which an electric field produced between the paper and the photosensitive drum causes developer to scatter from the photosensitive drum onto the paper.

To resolve this problem, a guide plate has conventionally been provided on the upstream side of the transfer position for guiding the paper toward the photosensitive drum in order to suppress pre-transfer. This technology is disclosed in Japanese unexamined patent application publication No. 2003-5535 (FIG. 1).

However, when the trailing edge (upstream end) of the paper passes over the edge of the guide plate in the technology described above, the trailing edge supported on the guide plate to that point becomes free and flaps. Flapping in the trailing edge of the paper can cause problems in transferring the developer, leading to a reduced quality in the image formed on the paper.

SUMMARY OF THE INVENTION

Therefore, it is an object of the present invention to provide an image-forming device and a process cartridge capable of improving the quality of an image formed on paper by suppressing flapping in the trailing edge of the paper when the trailing edge passes over the edge of the guide plate.

The above and other objects will be attained by an image-forming device that includes an image-carrying member, a transferring unit, a guide plate, and a cushioning member. The image-carrying member carries a developer image. The transferring unit is disposed in confrontation with the image-carrying member and transfers the developer image on the image-carrying member to a recording sheet. The conveying unit conveys the recording sheet to a transfer position between the image-carrying member and the transferring unit. The guide plate guides the recording sheet toward the image-carrying member. The cushioning member is disposed between the guide plate and the transfer position and receives at least a portion of the recording sheet. It is desirable that a material of the cushioning member be softer than a material from which the guide plate is formed.

When the image-carrying member is a photosensitive drum, this photosensitive drum may be provided in a process cartridge that is detachably mounted in the image-forming device. In this case, the guide plate and the cushioning member may also be provided in the process cartridge.

By providing a cushioning member that is softer than the guide plate between the guide plate and the transfer position, the cushioning member can receive the trailing edge of the paper leaving the edge of the guide plate to suppress flapping of the trailing edge.

By receiving the trailing edge of the paper leaving the edge of the guide plate, the cushioning member in the present invention restrains flapping of the trailing edge, thereby improving the quality of the image formed on the paper.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Next, a preferred embodiment of the present invention will be described.

Figure 1:
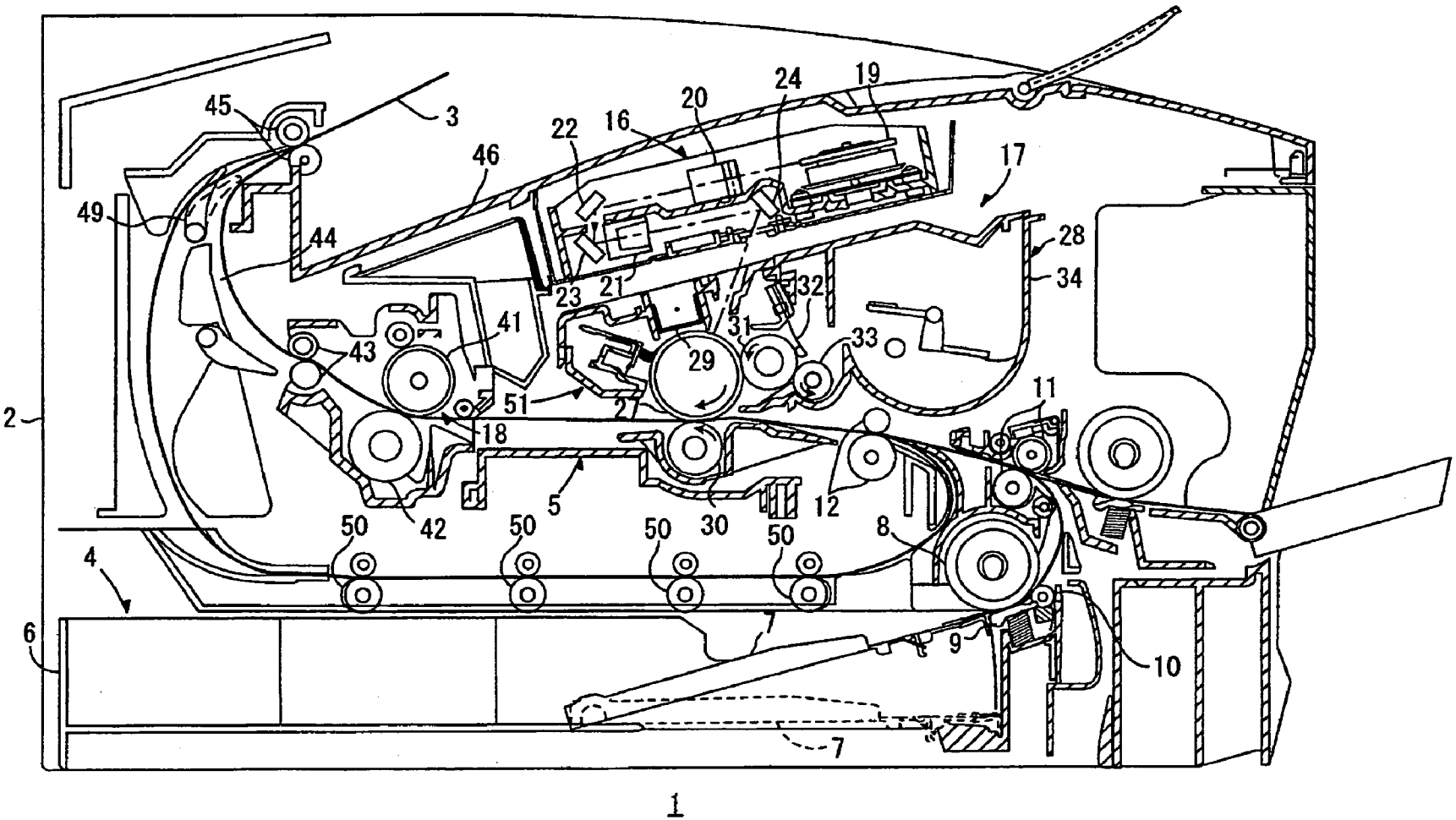
FIG. 1 is a side cross-sectional view of a laser printer serving as a preferred embodiment of the image-forming device according to the present invention.

First, the overall structure of a laser printer will be briefly described as an example of the image-forming device according to the present invention. FIG. 1 is a side cross-sectional view of a laser printer 1 serving as a preferred embodiment of the image-forming device according to the present invention. As shown in FIG. 1, the laser printer 1 includes a main casing 2 and, within the main casing 2, a feeding unit 4 for feeding sheets of a paper 3, and an image-forming unit 5 for forming images on the paper 3 supplied by the feeding unit 4.

The feeding unit 4 includes a paper tray 6 detachably mounted in the bottom section of the main casing 2, a paper-pressing plate 7 provided inside the paper tray 6, a feeding roller 8 and a feeding pad 9 disposed above one end of the paper tray 6, paper dust rollers 10 and 11 disposed downstream of the feeding roller 8 in the conveying direction of the paper 3, and registration rollers 12 disposed downstream of the paper dust rollers 10 and 11. In the following description, upstream or downstream in the paper-conveying direction may simply be referred to as "upstream" or "downstream," and the upstream edge or downstream edge of the sheet of paper 3 being conveyed may be referred to as the "trailing edge" or the "front edge," respectively.

In the feeding unit 4 having the construction described above, sheets of the paper 3 are loaded in the paper tray 6 and pressed toward the feeding roller 8 side by the paper-pressing plate 7. The paper 3 fed one sheet at a time by the feeding roller 8 and feeding pad 9 pass through the various rollers 10-12 and are conveyed by these rollers to the image-forming unit 5 (specifically, a transfer position C shown in FIG. 2).

The image-forming unit 5 includes a scanning unit 16, a process cartridge 17, and a fixing unit 18.

The scanning unit 16 is disposed in the upper section of the main casing 2 and includes a laser light-emitting element (not shown), a polygon mirror 19 that is driven to rotate, lenses 20 and 21, and reflecting mirrors 22, 23, and 24. The laser light-emitting element emits a laser beam based on image data. As indicated by the dotted line in FIG. 1, the laser beam sequentially passes through or is reflected off the polygon mirror 19, lens 20, reflecting mirror 22, reflecting mirror 23, lens 21, and reflecting mirror 24, and is irradiated in a high-speed scan onto the surface of a photosensitive drum 27 in the process cartridge 17 described next.

The process cartridge 17 is disposed beneath the scanning unit 16 and is constructed to be detachably mounted in the main casing 2. The outer frame of the process cartridge 17 is configured of a hollow casing 51, within which are primarily provided a developer cartridge 28, the photosensitive drum 27, a scorotron charger 29, and a transfer roller 30.

The developer cartridge 28 is detachably mounted in the casing 51 and includes a developing roller 31, a thickness-regulating blade 32, a supply roller 33, and a toner hopper 34. The supply roller 33 rotates in the direction of the arrow (counterclockwise in FIG. 1) to supply toner from the toner hopper 34 to the developing roller 31. At this time, the toner is positively tribocharged between the supply roller 33 and developing roller 31. As the developing roller 31 rotates in the direction of the arrow (counterclockwise in FIG. 1), toner supplied onto the developing roller 31 passes between the developing roller 31 and the thickness-regulating blade 32 and is regulated to a thin film of a fixed thickness on the developing roller 31.

The photosensitive drum 27 is supported in the casing 51 so as to be capable of rotating in the direction of the arrow (clockwise in FIG. 1). The photosensitive drum 27 is configured of a main drum body that is grounded, and a positive-charging photosensitive layer of polycarbonate formed on the surface thereof.

The charger 29 is disposed above and in confrontation with the photosensitive drum 27 but separated a prescribed distance therefrom so as not to contact the photosensitive drum 27. The charger 29 is a positive-charging scorotron charger that produces a corona discharge from a charging wire formed of tungsten or the like for charging the surface of the photosensitive drum 27 with a uniform positive polarity.

The transfer roller 30 is disposed below the photosensitive drum 27, confronting and contacting the same, and is supported in the casing 51 so as to be capable of rotating in the direction of the arrow (counterclockwise in FIG. 1). The transfer roller 30 is configured of a metal roller shaft coated with an electrically conductive rubber material. During a transfer operation, a transfer bias is applied to the transfer roller 30 through constant current control. A transfer position C (see FIG. 2) is formed at the point of contact between the transfer roller 30 and photosensitive drum 27 (nip point).

After the charger 29 charges the surface of the photosensitive drum 27 with a uniform positive polarity, the scanning unit 16 irradiates a laser beam in a high-speed scan over the surface of the photosensitive drum 27 based on image data. The areas of the photosensitive drum 27 exposed to the laser beam have a lower potential and form an electrostatic latent image. Here, the "electrostatic latent image" indicates areas on the surface of the photosensitive drum 27 carrying a uniformly positive charge that were exposed to the laser beam and, therefore, have a lower potential. As the developing roller 31 rotates, the toner carried on the developing roller 31 confronts and contacts the photosensitive drum 27, at which time toner is supplied to the electrostatic latent image formed on the surface of the photosensitive drum 27. The toner is selectively transferred to and carried on the surface of the photosensitive drum 27, developing the latent image into a visible image through reverse development to form a toner image on the photosensitive drum 27.

Figure 2:
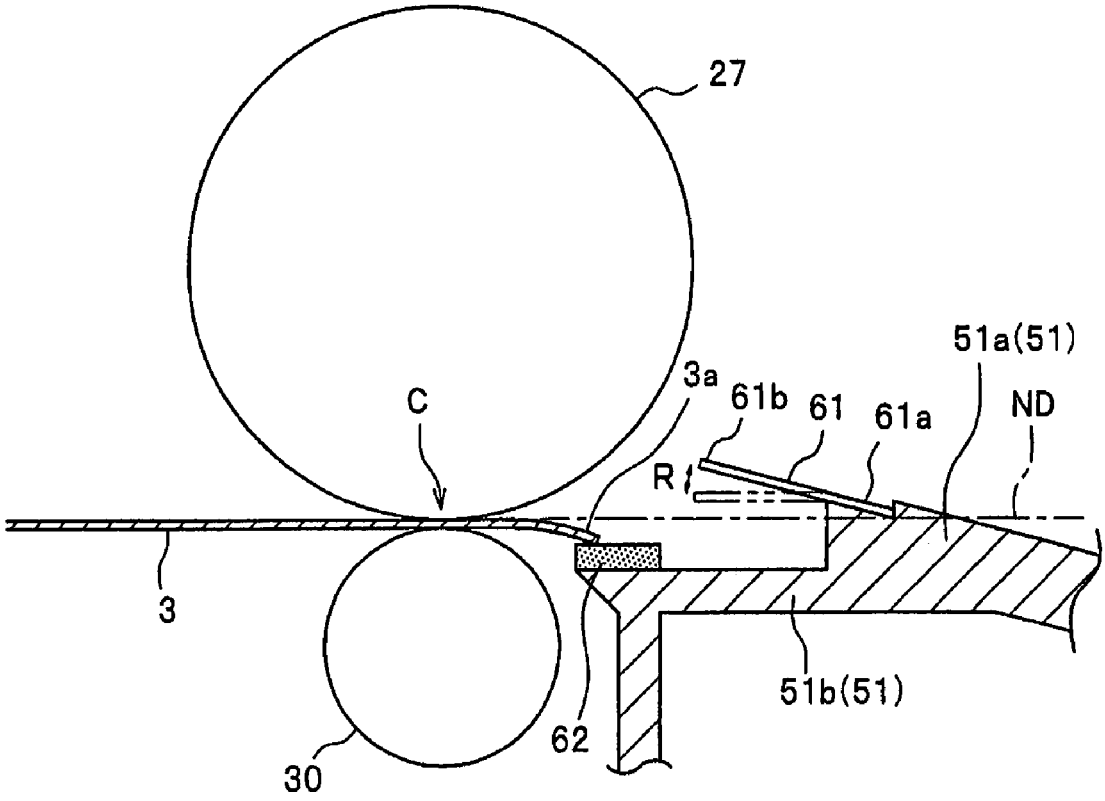
FIG. 2 is a side cross-sectional view showing a simplified structure near a transfer position in the laser printer of FIG. 1.

As the photosensitive drum 27 and transfer roller 30 are driven to rotate, a sheet of the paper 3 is pinched between the photosensitive drum 27 and transfer roller 30 at the transfer position C shown in FIG. 2. The photosensitive drum 27 and transfer roller 30 convey the sheet of paper 3 while the toner image carried on the surface of the photosensitive drum 27 is transferred onto the paper 3.

The fixing unit 18 is disposed on the downstream side of the process cartridge 17 and includes a heating roller 41, a pressure roller 42 disposed in confrontation with the heating roller 41 and applying pressure to the same, and a pair of conveying rollers 43 disposed downstream of the heating roller 41 and pressure roller 42. The fixing unit 18 having this construction fixes the toner transferred onto the paper 3 with heat as the paper 3 passes between the heating roller 41 and pressure roller 42. Subsequently, the conveying rollers 43 convey the sheet of paper 3 along a discharge path 44. Discharge rollers 45 receive the paper 3 conveyed along the discharge path 44 and discharge the paper 3 onto a discharge tray 46. Alternatively, the sheet of paper 3 may be returned into the device by reversing the rotation of the discharge rollers 45 and switching a flapper 49. In this case, a plurality of reverse conveying rollers 50 convey the sheet of paper 3 in an inverted state back to the upstream side of the image-forming unit 5 to perform a duplex print.

Next, the structure of the area near the transfer position C, which structure is a feature of the present invention, will be described in greater detail. FIG. 2 is a side cross-sectional view showing a simplified structure near the transfer position C in the laser printer of FIG. 1. Some parts in the structure around the transfer position C in FIG. 1 have been omitted for the convenience of description.

As shown in FIG. 2, a guide plate 61 for guiding the paper 3 toward the photosensitive drum 27, and a cushioning member or a sponge 62 are sequentially disposed with respect to the paper-conveying direction on the upstream side of the contact point (transfer position C) between the photosensitive drum 27 and transfer roller 30.

The guide plate 61 is a substantially rectangular film member formed through a pressing process or the like. Specifically, the guide plate 61 is formed of a flexible insulating material, such as polyethylene terephthalate or another resin. The guide plate 61 is sloped upward in the paper-conveying direction. A base end 61*a* on the upstream end of the guide plate 61 is fixed to a first seat 51*a*. With the guide plate 61 fixed in a sloped state by the first seat 51*a* as described above, the downstream end 61*b* of the guide plate 61 is swingably supported about the base end 61*a* while constantly extending toward the photosensitive drum 27.

The top surface of the first seat 51*a* has a stepped shape in which the region upstream of the region fixing the guide plate 61 is raised an amount greater than or equal to the thickness of the guide plate 61 to prevent paper jams. A second seat 51*b* is formed along the bottom of the first seat 51*a* at a position lower than the transfer position C. The second seat 51*b* extends toward the transfer position C along a nip conveying direction ND. The "nip conveying direction ND" is the direction in which the image-carrying member and the transferring means convey the recording sheet. When the image-carrying member and the transferring means are both configured of rollers, as in the preferred embodiment, the nip conveying direction ND is the direction along a common tangent to both rollers when viewed from the side (a direction orthogonal to a line connecting the axes of the two rollers). The first and second seats 51*a* and 51*b* constitute parts of the casing 51.

Stated differently, the top surface of the second seat 51 extends in parallel with a reference plane that is orthogonal to a plane including the rotation axes of the photosensitive roller 27 and the transfer roller 30 and the transfer position C.

The sponge 62 is a porous member that is softer than the guide plate 61 and has a rectangular shape. The sponge 62 is disposed outside a swinging range R of the guide plate 61 and, more specifically, is disposed on the second seat 51*b* nearer the transfer position C side than the distal end 61*b* on the guide plate 61. The sponge 62 is disposed at a position for contacting a trailing edge 3*a* of the paper 3 when the trailing edge 3*a* swings downward after leaving the guide plate 61. Here, the "swinging range R" is the range in which the guide plate 61 actually bends and swings due to the force applied from the paper 3, i.e. a fan-shaped range from the position in which the guide plate 61 is in a straight state to the farthest position in which the guide plate 61 is bent by a stiff paper 3, such as a sheet of thick paper. The guide plate 61 does not contact the sponge 62 within the swinging range R.

Figure 3A:
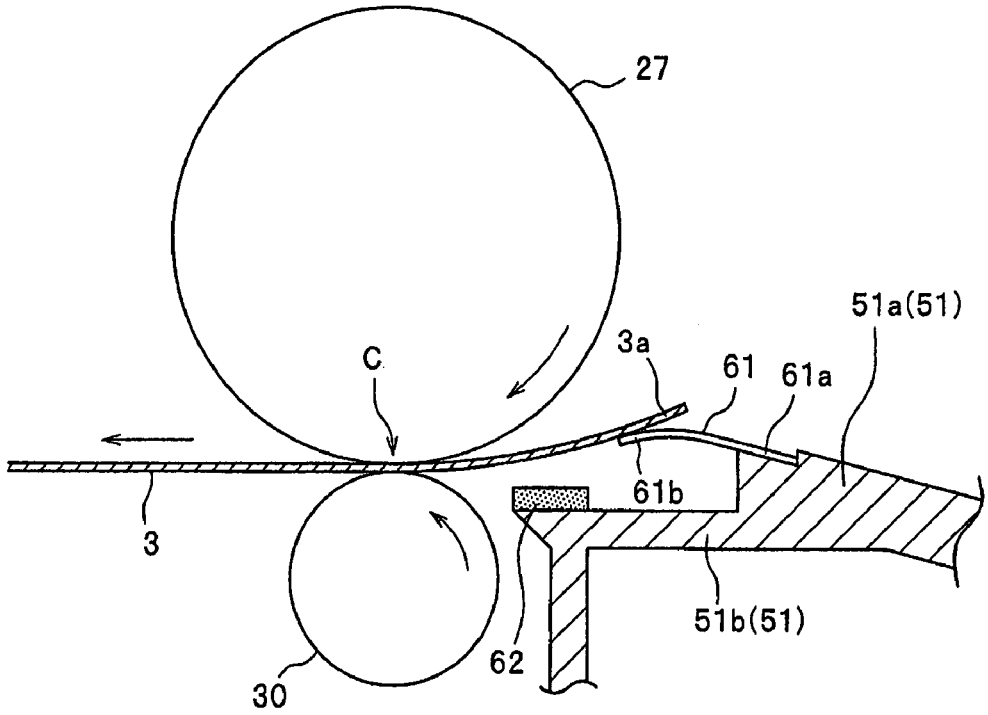
FIG. 3A is a side cross-sectional view showing a guide plate supporting the trailing edge of a sheet of paper.
Figure 3B:
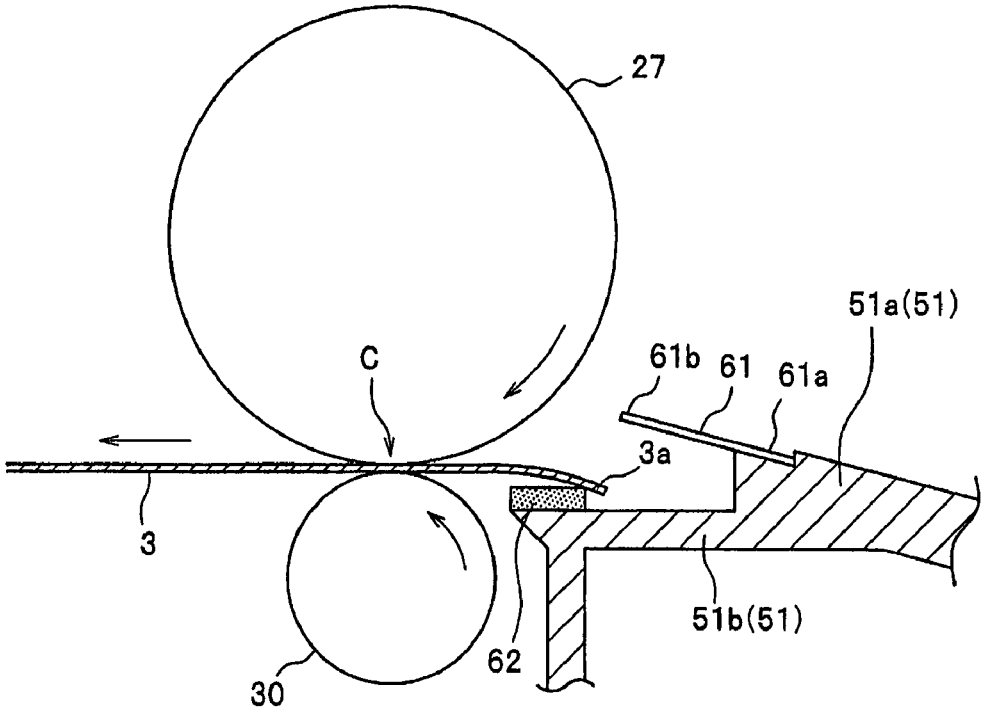
FIG. 3B is a side cross-sectional view showing the trailing edge of the paper after leaving the edge of the guide plate.

Next, the operation of the sponge 62 when the trailing edge 3*a* of the paper 3 leaves the guide plate 61 will be described with reference to FIG. 3A and FIG. 3B. FIG. 3A is a side cross-sectional view showing the guide plate 61 supporting the trailing edge 3*a* of a sheet of paper 3, and FIG. 3B is a side cross-sectional view showing the trailing edge 3*a* of the paper 3 after leaving the edge of the guide plate 61.

When the paper 3 is conveyed from right to left in the drawings, the guide plate 61 urges the paper 3 toward the photosensitive drum 27 to suppress pre-transfer until the trailing edge 3*a* of the paper 3 leaves the guide plate 61, as shown in FIG. 3A. When the trailing edge 3*a* of the paper 3 leaves the guide plate 61, as shown in FIG. 3B, the trailing edge 3*a* swings downward. At this time, the sponge 62 receives the trailing edge 3*a* to suppress flapping in the same. Since the sponge 62 is formed of a softer material than the guide plate 61, the trailing edge 3*a* produces almost no sound when striking the sponge 62 at this time. Subsequently, the trailing edge 3*a* of the paper 3 is conveyed to the transfer position C while supported on the sponge 62.

The structure of the preferred embodiment described above has the following effects.

By receiving the trailing edge 3*a* of the paper 3 when the trailing edge 3*a* leaves the guide plate 61, the sponge 62 suppresses flapping in the trailing edge 3*a*, thereby improving the quality of an image formed on the paper 3.

By forming the sponge 62 softer than the guide plate 61, the trailing edge 3*a* of the paper 3 makes almost no sound when swinging against the sponge 62, so that the user feels no unpleasantness when using the laser printer 1. Use of the sponge 62 as a cushioning member can further enhance the sound-absorbing effect since the pores in the sponge 62 can absorb sound.

Disposing the sponge 62 outside the swinging range R of the guide plate 61 prevents the flow of electricity to the paper 3 through contact between the guide plate 61 and sponge 62, thereby further suppressing a drop in the quality of images formed on the paper 3 caused by the transfer bias.

Further, disposing the sponge 62 outside the swinging range R of the guide plate 61 prevents the sponge 62 from interfering with flexural deformation of the guide plate 61. Hence, the guide plate 61 can bend suitably, even when the paper 3 is a thick sheet of paper, reducing the likelihood of paper jams.

While the invention has been described in detail with reference to specific embodiments thereof, it would be apparent to those skilled in the art that many modifications and variations may be made therein without departing from the spirit of the invention, the scope of which is defined by the attached claims.

For example, the sponge 62 (cushioning member) may be configured in a variety of shapes, as described below.

Figure 4:
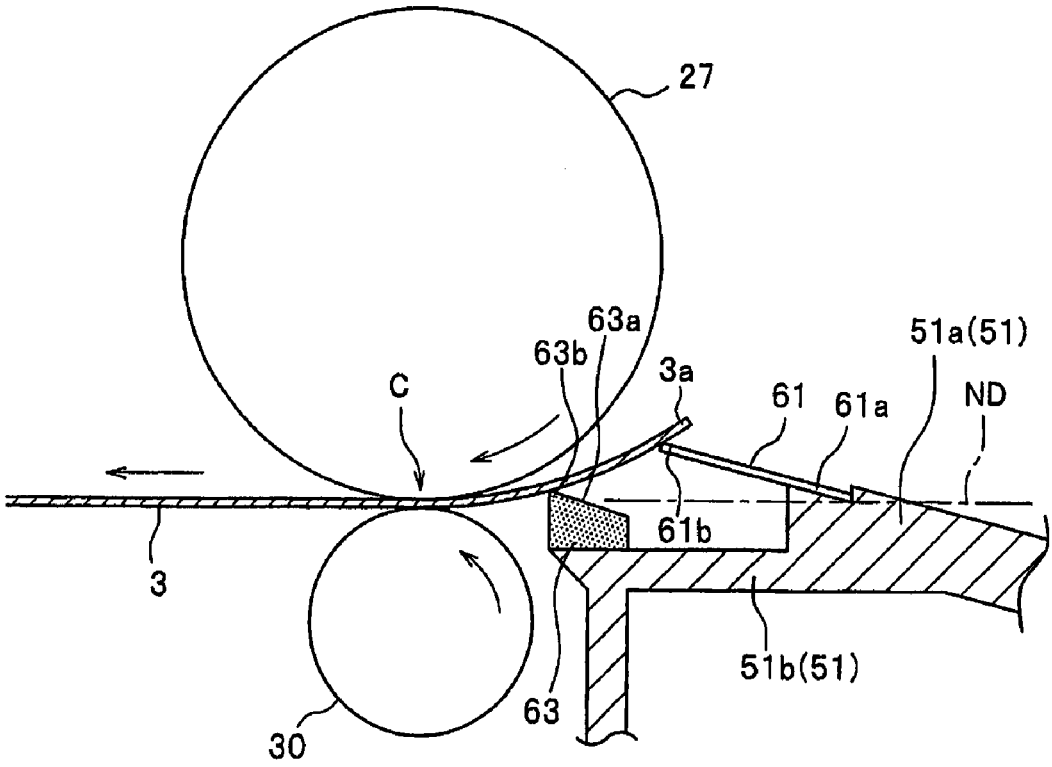
FIG. 4 is a side cross-sectional view showing a sponge according to a first variation of the embodiment.

FIG. 4 shows a sponge 63 according to a first variation of the embodiment. The sponge 63 has a top surface 63*a* that slopes relative to the nip conveying direction ND or the reference plane, so that the downstream side of the top surface 63*a* is closer to the photosensitive drum 27 than (positioned higher than) the upstream side. In other words, the top surface 63*a* of the sponge 63 has a downward slope from the downstream side to the upstream side. A corner 63*b* forming a portion of the sponge 63 on the top downstream end is positioned higher than the transfer position C.

The sponge 63 according to the first variation described above has the following effects. Since the top surface 63*a* of the sponge 63 slopes downward from the downstream side toward the upstream side, the sloped top surface 63*a* can receive the leading edge of the paper 3 and reliably guide the leading edge toward the photosensitive drum 27, even when the leading edge of the paper 3 is curled downward.

Further, by positioning the corner 63*b* of the sponge 63 higher than the transfer position C, the corner 63*b* can support the paper 3 at a position approaching the photosensitive drum 27, thereby further suppressing pre-transfer.

Figure 5:
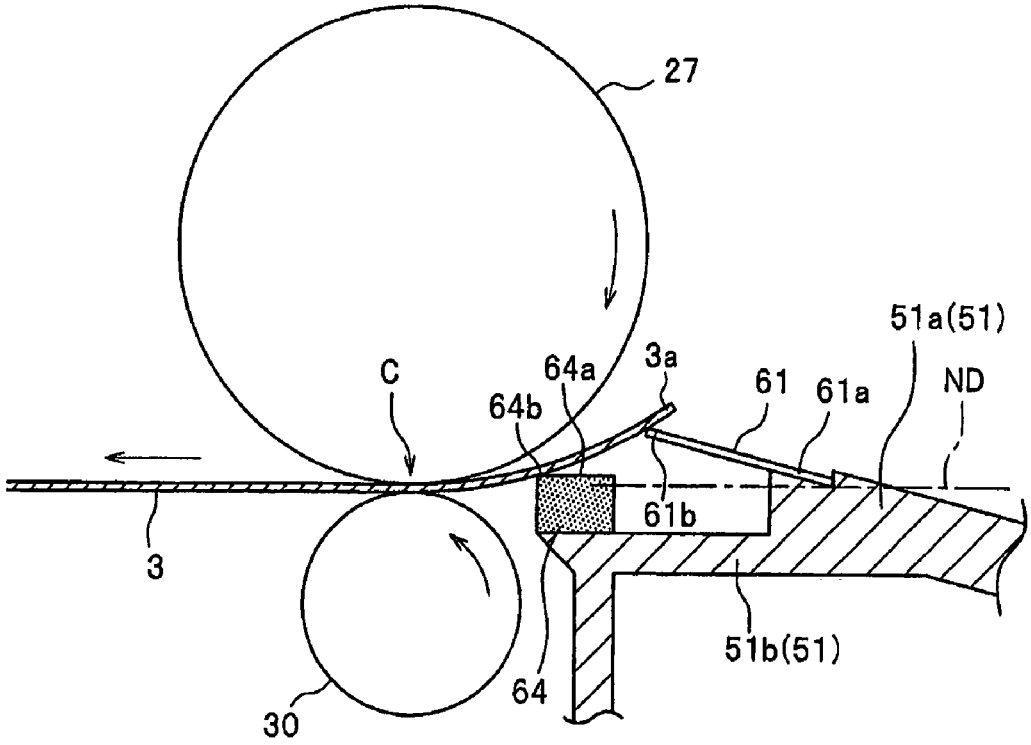
FIG. 5 is a side cross-sectional view showing a sponge according to a second variation of the embodiment.

FIG. 5 shows a sponge 64 according to a second variation of the embodiment. The sponge 64 is formed in a rectangular shape having a prescribed uniform thickness in the vertical dimension, such that a top surface 64*a* of the sponge 64 runs parallel to the nip conveying direction ND or the reference plane and is at a position higher than the transfer position C. In other words, a corner 64*b* is formed at an angle of 90° on the top downstream side of the sponge 64 in a region that contacts the paper 3 and is positioned higher than the transfer position C.

The sponge 64 according to the second variation described above has the following effects.

Since the top surface 64*a* of the sponge 64 runs parallel to the nip conveying direction ND and the corner 64*b* that contacts the paper 3 forms an angle of 90°, the corner 64*b* supporting the paper 3 is unlikely to be compressed by the force of the paper 3, thereby maintaining the paper 3 at a substantially fixed position.

Further, since the corner 64*b* of the sponge 64 is positioned higher than the transfer position C, the corner 64*b* can support the paper 3 at a position approaching the photosensitive drum 27, thereby suppressing pre-transfer.

Figure 6:
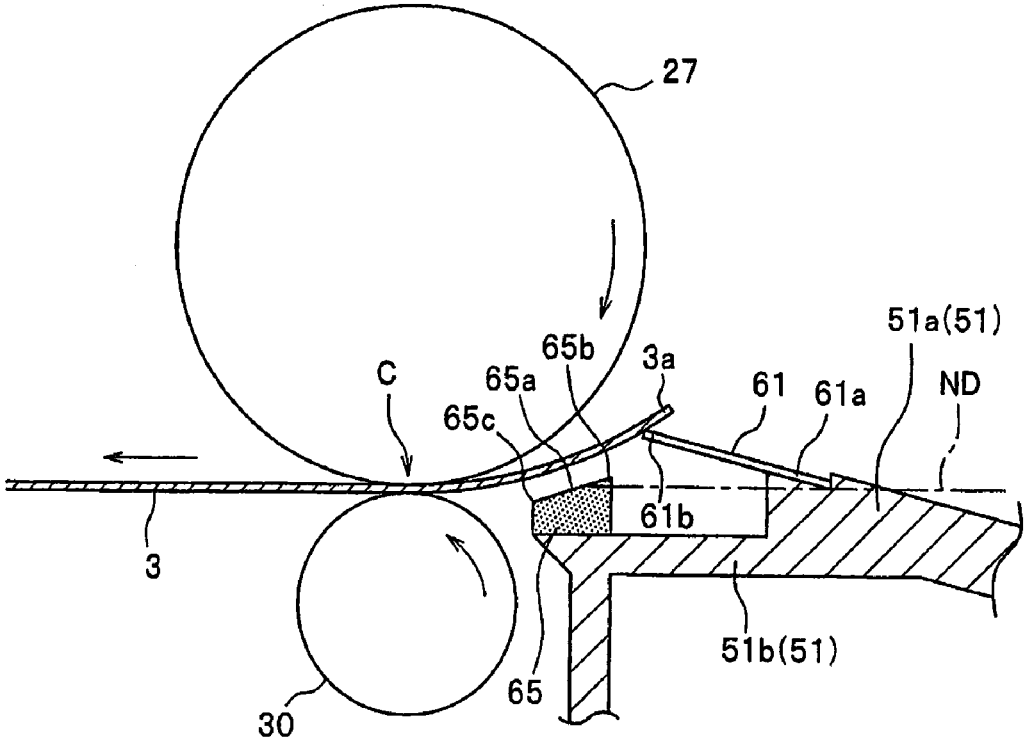
FIG. 6 is a side cross-sectional view showing a sponge according to a third variation of the embodiment.

FIG. 6 shows a sponge 65 according to a third variation of the embodiment. The sponge 65 has a top surface 65*a* that slopes relative to the nip conveying direction ND or the reference plane so that the downstream side of the top surface 65*a* is closer to the transfer roller 30 with respect to the vertical (positioned lower) than the upstream side. In other words, the top surface 65*a* of the sponge 65 has an upward slope from the downstream side to the upstream side. Further, a corner 65*b* forming a portion of the sponge 65 on the top upstream side thereof is positioned higher than the transfer position C. A corner 65*c* on the top downstream side of the sponge 65 is formed at an obtuse angle since the top surface 65*a* slopes upward from the downstream side to the upstream side.

The sponge 65 according to the third variation described above has the following effects.

Since the top surface 65*a* of the sponge 65 slopes upward from the downstream side to the upstream side, the region of the sponge 65 contacting the paper 3 is either the top surface 65*a* itself or the corner 65*c* formed as an obtuse angle on the top downstream side of the sponge 65. Accordingly, the region supporting the paper 3 is unlikely to be compressed downward by the force of the paper 3, thereby maintaining the paper 3 at a substantially constant position.

Further, since the corner 65*b* on the top upstream side of the sponge 65 is positioned higher than the transfer position C (closer to the photosensitive drum 27 side with respect to the vertical), the top surface 65*a* formed in the vicinity of the corner 65*b* can support the paper 3 at a position approaching the photosensitive drum 27, thereby further suppressing pre-transfer.

Figure 7:
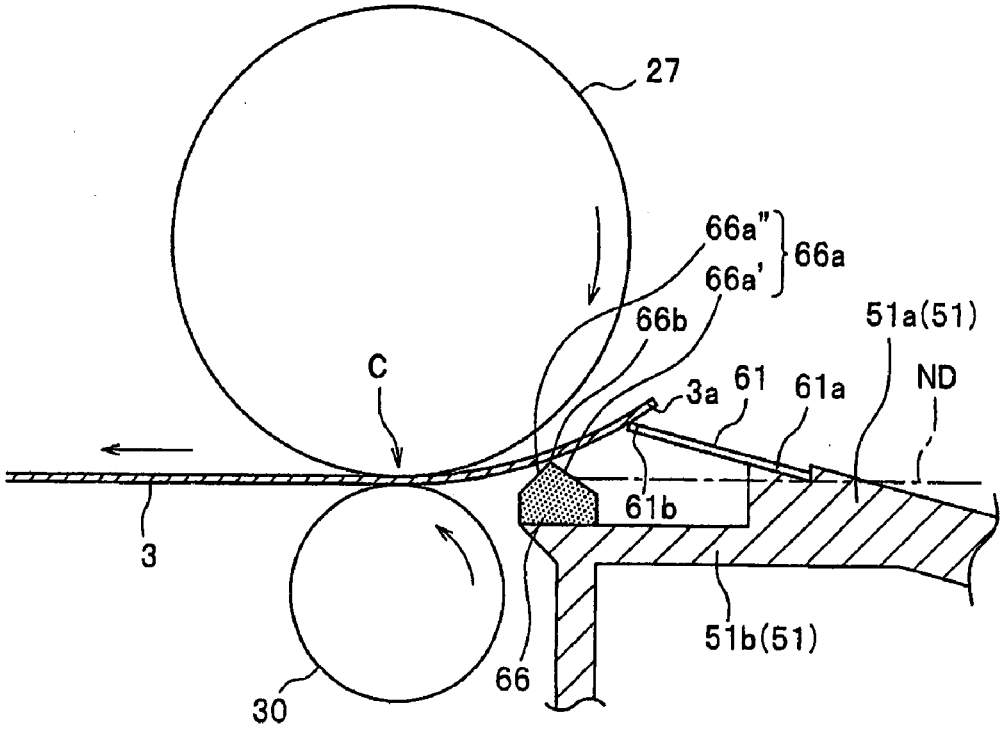
FIG. 7 is a side cross-sectional view showing a sponge according to a fourth variation of the embodiment.

FIG. 7 shows a sponge 66 according to a fourth variation of the embodiment. The sponge 66 has a top surface 66*a* formed in a chevron shape with an upstream surface 66*a*' and a downstream surface 66*a*", both of which are sloped relative to the nip conveying direction ND or the reference plane. An apex 66*b* of the chevron-shaped sponge 66 is formed at a position higher than the transfer position C (closer to the photosensitive drum 27 side with respect to the vertical).

The sponge 66 according to the fourth variation described above has the following effects.

Since the upstream surface 66*a*' slopes downward from the downstream side to the upstream side, the sloped upstream surface 66*a*' can receive the leading edge of the paper 3 and reliably guide the leading edge toward the photosensitive drum 27, even if the leading edge of the paper 3 is curled downward, for example.

Further, by sloping the downstream surface 66*a*" upward from the downstream side to the upstream side, the region of the top surface 66*a* contacting the trailing edge 3*a* of the paper 3 is either the downstream surface 66*a*" itself or a corner having an obtuse angle on the top downstream side thereof. Accordingly, the region contacting the trailing edge 3*a* of the paper 3 is less likely to buckle under the force of the paper 3, thereby maintaining the paper 3 at a substantially constant position.

Further, since the apex 66*b* of the sponge 66 is positioned higher than the transfer position C, the apex 66*b* can support the paper 3 at a position approaching the photosensitive drum 27 side, thereby further suppressing pre-transfer.

The cushioning members described above in the preferred embodiment and the variations thereof, i.e. the sponges 62-66, may be divided into a plurality of pieces arranged at prescribed intervals in the width direction of the paper (a direction parallel to the surface of the paper and orthogonal to the conveying direction). This arrangement reduces frictional resistance between the paper and the cushioning members, allowing the paper to be smoothly conveyed.

Although the present invention has been described with respect to specific embodiments, it will be appreciated by one skilled in the art that a variety of changes may be made without departing from the scope of the invention.

In the preferred embodiment described above, the present invention is applied to the laser printer 1, but the present invention may also be applied to other image-forming devices, such as a photocopier or a multifunction device.

In the preferred embodiment described above, the photosensitive drum 27 serves as an example of the image-carrying member, but the image-carrying member may also be an intermediate transfer belt or a photosensitive belt for carrying toner, for example.

In the preferred embodiment described above, the sponge 62 serves as an example of the cushioning member, but the cushioning member may also be formed of rubber, felt, or the like.

In the preferred embodiment described above, the feeding roller 8, paper dust rollers 10 and 11, and registration rollers 12 serve as conveying means, but the present invention is not limited to any particular configuration. For example, the conveying means may be a mechanism for conveying paper inserted by hand through a manual feed tray to the transfer position.

In the preferred embodiment described above, the transfer roller 30 serves as the transferring means, but the present invention is not limited to this configuration. For example, the transferring means may be a non-contact type device.

In the preferred embodiment described above, the recording sheet is described as the paper 3, which may be a thick sheet, thin sheet, postcard, and the like, but the recording sheet in the present invention may also be a transparency, for example.

In the preferred embodiment described above, the sponge 62 serving as the cushioning member is disposed closer to the transfer position C than the distal end 61*b* of the guide plate 61. However, the sponge 62 may extend beneath the guide plate 61, provided that the sponge 62 is outside the swinging range R of the guide plate 61. Since the mounting surface (bottom surface) of the sponge 62 is widened in this case, the sponge 62 can be mounted on the second seat 51*b* with stability.

In the preferred embodiment described above, dispose the sponge 62 outside the swinging range R of the guide plate 61 prevents the flow of electricity to the paper 3 through contact between the guide plate 61 and sponge 62, but a portion of the sponge 62 may be disposed within the swinging range R of the guide plate 61 in some cases, such as when electricity does not flow to the paper 3 as described above, or when electricity flowing to the paper 3 does not affect image quality.

In the preferred embodiment described above, the photosensitive drum 27 is disposed on the top side of the transfer position, and the transfer roller 30 is disposed on the bottom side thereof, but the arrangement of the photosensitive drum 27 and the transfer roller 30 in the present invention may be modified as desired. For example, the laser printer 1 may be configured with the photosensitive drum 27 on the bottom side of the transfer position and the transfer roller 30 on the top side, or with the photosensitive drum 27 on the left side and the transfer roller 30 on the right side.

In the preferred embodiment described above, the nip conveying direction ND follows the horizontal, but the nip conveying direction ND may be sloped relative to the horizontal, for example.

In the preferred embodiment described above, the guide plate 61 is disposed on the process cartridge 17 side, but the guide plate 61 may be disposed on the laser printer 1 side (the main body of the printer) instead.

In the preferred embodiment described above, the sponge 62 is disposed on the process cartridge 17 side, but the sponge 62 may be disposed on the laser printer 1 side (the main body of the printer) instead.

In the preferred embodiment described above, the first seat 51*a* is disposed on the process cartridge 17 side, but the first seat 51*a* may be disposed on the laser printer 1 side (the main body of the printer) instead.

In the preferred embodiment described above, the second seat 51*b* is disposed on the process cartridge 17 side, but the second seat 51*b* may be disposed on the laser printer 1 side (the main body of the printer) instead.

In the preferred embodiment described above, the first and second seats 51*a* and 51*b* constitute parts of the casing 51, but the first and second seats 51*a* and 51*b* may be configured separately from each other or configured separately from the casing 51.

In the preferred embodiment described above, the transfer roller 30 is disposed on the process cartridge 17 side, but the transfer roller 30 may be disposed on the laser printer 1 side (the main body of the printer) instead.

In the preferred embodiment described above, the present invention is applied to a printer that charges toner with a positive polarity, but the present invention may also be applied to a printer that charges toner with a negative polarity.

The guide plate may also have one of the following constructions.

(1) The guide plate may be divided into a plurality of pieces that are arranged at prescribed intervals in the width direction of the paper. This configuration can reduce frictional drag between the paper and the guide plate, allowing the paper to be smoothly conveyed.

(2) One or a plurality of slits or notches extending in the paper-conveying direction may be formed in the distal edge of the guide plate. With this construction, the guide plate can be mounted with greater precision and without wrinkling. In this example, holes may be formed at the root of the slit or the like, or the notches may be shaped substantially rectangular or substantially U-shaped, for example, to prevent the guide plate from splitting along the slits or notches.

(3) When the guide plate is formed according to a pressing process, the surface of the plate that is first contacted by the cutting blade in the pressing process, i.e. the shear-drooped side, has smooth or rounded edges, while the side opposite the shear-drooped side may have edges or burrs. Since the paper may catch on these burrs, the guide plate is preferably disposed with the shear-drooped side as the top surface that contacts the paper to ensure that the paper is smoothly conveyed.

What is claimed is:

1. An image-forming device comprising:

an image-carrying member that carries a developer image;

a transferring unit that is disposed in confrontation with the image-carrying member and transfers the developer image on the image-carrying member to a recording sheet;

a conveying unit that conveys the recording sheet to a transfer position between the image-carrying member and the transferring unit, the recording sheet having a leading edge and a trailing edge;

a guide plate upwardly sloped in a recording sheet-conveying direction having a first edge portion nearest to the image-carrying member, and a second edge portion farthest from the image-carrying member, the guide plate guiding a lower surface the recording sheet toward the image-carrying member; and a cushioning member that is disposed between the guide plate and the transfer position and receives at least a portion of the recording sheet, the cushioning member being made from a material softer than the material from which the guide plate is made; wherein the guide is disposed above the cushioning member.

2. The image-forming device according to claim 1, further comprising a seat that supports the guide plate, wherein the second edge portion of the guide plate is fixed to the seat to allow the first edge portion to be swingable within a swinging range, and the cushioning member is disposed outside the swinging range.

3. The image-forming device according to claim 2, wherein the cushioning member is disposed in a position to receive the trailing edge of the recording sheet when the trailing edge of the recording sheet has passed the guide plate.

4. The image-forming device according to claim 1, wherein the image-carrying member comprises an image-carrying roller having a rotation axis to be rotatable thereabout, and the transferring unit comprises a transferring roller having a rotation axis to be rotatable thereabout, and the cushioning member has a top surface facing the recording sheet when the recording sheet is moving past the cushioning member.

5. The image-forming device according to claim 4, wherein the top surface is substantially in parallel with a reference plane orthogonal to a plane including the rotation axes of the image-carrying roller and the transferring roller and the transfer position.

6. The image-forming device according to claim 4, wherein the top surface has an upward slop in a direction in which the recording sheet is conveyed relative to a reference plane orthogonal to a plane including the rotation axes of the image-carrying roller and the transferring roller and the transfer position.

7. The image-forming device according to claim 4, wherein the top surface has a downward slop in a direction in which the recording sheet is conveyed relative to a reference plane orthogonal to a plane including the rotation axes of the image-carrying roller and the transferring roller and the transfer position.

8. The image-forming device according to claim 4, wherein the top surface is formed in a chevron shape with a first surface and a second surface, the first surface being farther from the transfer position and sloped up, and the second surface being nearer to the transfer position and sloped down with respect to a direction in which the recording sheet is conveyed and to a reference plane orthogonal to a plane including the rotation axes of the image-carrying roller and the transferring roller and the transfer position.

9. The image-forming device according to claim 8, wherein the chevron shape has an apex positioned at a side of the image-carrying member relative to the reference plane.

10. The image-forming device according to claim 4, wherein at least a portion of the cushioning member is positioned at a side of the image-carrying member relative to the reference plane.

11. The image-forming device according to claim 1, wherein the cushioning member is formed of a sponge.

12. The image-forming device according to claim 1, wherein the guide plate comprises a substantially rectangular film.

13. The image-forming device according to claim 12, wherein the rectangular film is formed of a flexible insulating material.

14. A process cartridge detachably mounted in an image-forming device, the process cartridge comprising:

a photosensitive drum that carries a developer image, the developer image being transferred to a recording sheet;

a guide plate upwardly sloped in a recording sheet-conveying direction having a first edge portion nearest to the photosensitive drum, and a second edge portion farthest from the photosensitive drum, the guide plate guiding a lower surface of the recording sheet toward the photosensitive drum; and a cushioning member disposed in a position to receive a trailing portion of the recording sheet when the recording sheet has passed the guide plate, the cushioning member being made from a material softer than the material from which the guide plate is made; wherein the guide plate is disposed above the cushioning member.

15. The process cartridge according to claim 14, further comprising a seat that supports the guide plate, wherein the second edge portion of the guide plate is fixed to the seat to allow the first edge portion to be swingable within a swinging range, and the cushioning member is disposed outside the swinging range.

16. The process cartridge according to claim 14, wherein the cushioning member is formed of a sponge.

17. The process cartridge according to claim 14, wherein the guide plate comprises a substantially rectangular film.

18. The image-forming device according to claim 17, wherein the rectangular film is formed of a flexible insulating material.

* * * * *